US010794069B2

(12) United States Patent
Gill et al.

(10) Patent No.: US 10,794,069 B2
(45) **Date of Patent: *Oct. 6, 2020**

(54) DOOR HANGER BRACKET

(71) Applicant: Express Products, Inc., Grandville, MI (US)

(72) Inventors: Ryan L. Gill, Wyoming, MI (US); Michael J. Gill, Grand Rapids, MI (US); Dennis G. Gill, Grand Rapids, MI (US)

(73) Assignee: Express Products, Inc., Grandville, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/138,502

(22) Filed: Sep. 21, 2018

(65) Prior Publication Data

US 2020/0095782 A1 Mar. 26, 2020

(51) Int. Cl.
*E04F 21/00* (2006.01)
*E06B 1/60* (2006.01)

(52) U.S. Cl.
CPC ..... *E04F 21/0015* (2013.01); *E06B 1/6007* (2013.01)

(58) Field of Classification Search
CPC ..... E06B 1/6007; E06B 1/60; E06B 1/6015; E04F 21/0015
USPC ..... 52/213
See application file for complete search history.

(56) References Cited

U.S. PATENT DOCUMENTS 1,599,985 A * 9/1926 Carlson ..... E06B 1/6015 403/281
1,621,213 A * 3/1927 Olson ..... E06B 1/6015 411/457
1,697,456 A * 1/1929 Carlson ..... E06B 1/6015 411/461
4,014,146 A * 3/1977 DiMascio ..... E06B 1/6015 52/211
4,764,072 A * 8/1988 Atack ..... E04B 1/49 411/452
4,840,002 A 6/1989 Lovgren
4,986,044 A 1/1991 Funari
(Continued)

FOREIGN PATENT DOCUMENTS

DE 1683003 A1 * 1/1971 ..... E06B 1/6023
DE 2633121 A1 * 2/1978 ..... E06B 1/526
EP 1396602 3/2004

*Primary Examiner* — Adriana Figueroa
(74) *Attorney, Agent, or Firm* — Mitchell Intellectual Property Law, PLLC

(57) ABSTRACT

A door assembly, a hanger bracket therefor which comprises an elongated manually bendable body which extends from a first wall mounting tab at one end, for a distance approximately equal to the width of a door jamb, and sufficiently far beyond to provide for forming a second wall mounting tab. The elongated body includes at least one bend line extending laterally with respect to the length of said body, whereby the body can be manually bent to form said second wall mounting tab, after the bracket has been secured to the jamb of the door assembly and the door assembly located in the door opening of the wall and secured to one side of the wall by the first wall mounting tab. Two bend lines are shown such that the bracket can be used in a wall having drywall on both sides, or in a wall having drywall on only one side.

21 Claims, 8 Drawing Sheets

(56) References Cited

U.S. PATENT DOCUMENTS

| | | | | |
|---|---|---|---|---|
| 5,119,609 | A | 6/1992 | Tait et al. | |
| 5,655,342 | A * | 8/1997 | Guillemet | E06B 1/60 49/505 |
| 5,692,350 | A | 12/1997 | Murphy, Jr. | |
| 5,771,644 | A | 6/1998 | Kidd | |
| 6,178,717 | B1 | 1/2001 | Loop | |
| 6,192,638 | B1 * | 2/2001 | Wang | E06B 1/10 49/504 |
| 6,286,274 | B1 | 9/2001 | McKann et al. | |
| 6,293,061 | B1 * | 9/2001 | Horak, Jr. | E06B 1/6015 52/213 |
| 7,716,886 | B2 * | 5/2010 | Gordon | E06B 1/60 206/325 |
| 8,333,359 | B2 * | 12/2012 | Gordon | E06B 1/6015 248/223.21 |
| RE45,355 | E | 2/2015 | Gill | |
| 2001/0010167 | A1 * | 8/2001 | Leek | B21D 5/0209 72/379.2 |
| 2004/0060241 | A1 | 4/2004 | Staples et al. | |
| 2004/0134250 | A1 | 7/2004 | Durney et al. | |
| 2008/0054137 | A1 * | 3/2008 | Poulin | E06B 1/6015 248/208 |
| 2008/0127564 | A1 * | 6/2008 | Burton | E06B 1/6015 49/380 |
| 2008/0222980 | A1 | 9/2008 | Root et al. | |
| 2011/0024591 | A1 | 2/2011 | Gordon | |
| 2012/0260589 | A9 * | 10/2012 | Davis | E06B 1/62 52/210 |
| 2015/0159420 | A1 * | 6/2015 | Davis | E06B 1/62 52/211 |

* cited by examiner

DOOR HANGER BRACKET

FIELD OF THE INVENTION

The invention relates to door assembly hanger brackets and their use in combination with door assemblies to hang the door assemblies.

BACKGROUND ART

Historically, many types of door assemblies are utilized in various environments, including, for example, residential, commercial and office interiors. Although numerous types of doors are well known in the art, a typical door assembly may include a door frame or jamb, as well as the door itself. The door frame can include what is characterized as a header jamb assembly for the top of the doorway opening within a wall or the like. Latch and hinge jamb sections are also utilized, for the sides of the doorway opening in the wall. With these types of configurations, it is necessary to be able to accommodate for variations in the thickness and alignment of the wall within which the door is to be located. Accordingly, it is necessary for the door frame to be adjustably positioned so to accommodate these wall thicknesses and variations in alignment. It is not uncommon for door assemblies today to be packaged as a combination of a "pre-hung" door which is hinged to a prefabricated jamb, where the door and the jamb are sold as a single unit. As earlier described, the door jamb is installed within what is often a "rough" opening, framed with studs edged by liners. In the prior art, it is known to install the door assembly by placing the door jamb in the rough opening, and then plumbing the door jamb.

The prior art includes several door hanger brackets of different designs, intended to assist in mounting such "pre-hung" door assemblies in a wall opening. One such bracket is an elongated rectangular flat plate made of manually formable metal. It includes jamb mounting holes, and a pair of holes toward each end of the flat plate, located laterally adjacent one another to facilitate bending each end of the flat plate into a wall mounting flange. Located in each wall mounting flange portion is an edge notch to facilitate alignment with a plumb line on the wall, and a mounting slot to facilitate mounting to the wall. The flat plate is located on and attached to the door jamb with the end portions extending beyond the opposite edges of the jamb. The door assembly is positioned in a wall opening, and first one and then the other of the extending end portions are manually bent into a wall mounting tab for attaching to the opposite sides of the wall.

Horak, Jr., U.S. Pat. No. 6,293,061 issued Sep. 25, 2001 describes a system and method for installing a jamb within a wall having an inward face facing inwardly toward the door, and a peripheral face facing away from the door. A spaced apart series of clips are utilized, with each clip having an external arm and a transverse internal arm. The external arm is adapted for longitudinally directed and surficial attachment to the wall. The internal arm of each clip is separately attached along the peripheral face of the jamb. With the jamb positioned in the wall, the jamb is plumbed and the external arms of the clips are attached to the wall longitudinally. Plumb means are utilized for determining whether the jamb is plumb, with the plumb means having indicia on the external arm of the clip for alignment with a leveling tool. A deformation is included on the external arm, against which the leveling tool can be aligned.

Tait, et. al., U.S. Pat. No. 5,119,609 issued Jun. 9, 1992 describes the use of a plastic nailing fin for use with a window or door assembly. The nailing fin can be folded from a stored position in front, to a working position along the side. The fin runs the full length and width of a window frame or door frame. Installation requires use of a substantial number of nails.

Murphy, Jr., U.S. Pat. No. 5,692,350 issued Dec. 2, 1997 is an example of an apparatus and method for door leveling utilizing shims. Specifically, the Murphy, Jr. apparatus includes a spring shim and an anchor. The spring shim has a pressure foot at each of two ends for engaging either the wall or the closure, and an intermediate portion having a central aperture for receiving the anchor. The door closure is leveled and plumbed within the opening, by attaching a series of spring shims at spaced locations around the closure. The closure and attached spring shims are then positioned in the opening, followed by the engaging and penetrating of the anchors into the wall.

Kidd, U.S. Pat. No. 5,771,644 issued Jun. 30, 1998 discloses an anchoring clip for the installation of a door in stud or masonry walls. The clip is directed toward anchoring of the door, rather than accurate plumbing of the door assembly.

Lovgren, U.S. Pat. No. 4,840,002 issued Jun. 20, 1989 discloses a clip having one arm embedded in the edge of a door jamb, with another arm acting as a backer for the jamb. The leg of the clip is screwed into the edge of the jamb, and into a steel support stud. By screwing into the edge of the jamb and by embedding an arm into that edge, an obstruction is produced which hampers attaching trim around the door jamb. Lovgren discloses the use of specialized tongue flanges which are designed to fit into customized bores in the wood trim. In accordance with the foregoing, specialized trims must be utilized, and the Lovgren arrangement does not appear to be capable of use with standard door trims.

Funari, U.S. Pat. No. 4,986,044 issued Jan. 22, 1991 discloses a series of jamb assemblies where each consists of a fixed section and an adjustable section. Each fixed section has a series of snap-in guide clips supported on the section. The clips each have a plate-like body, with a leg at each end and an integral cantilever tongue extending generally parallel to, but converging toward, the plate-like body of the clip. In this manner, the tongue is deflected away from the plate-like body. A flange is also provided on the adjustable section, and is received between the cantilever tongue and one of the legs. The tongue of each clip frictionally engages the adjustable section holding it in the adjusted position on the door jamb.

McKann, et al., U.S. Pat. No. 6,286,274 issued Sep. 11, 2001 describes a coupling for mounting a door frame within an opening. The coupling includes two, substantially identical anchoring clips and two, substantially identical retaining clips. Each anchoring clip includes a base mounting portion and a resilient cantilever portion extending at a non-perpendicular angle from the base mounting portion. The anchoring clips are oriented in opposition to each other. Each retaining clip includes a base mounting section and an angled section extending in a cantilevered manner from its base mounting section. The retaining clips are oriented in a mirror image, so that the cantilever portions of the anchoring clips engage the angled sections of the retaining clips.

Staples, et. al., U.S. Patent Application Publication No. 2004/0060241 published Apr. 1, 2004 describes a single piece, unitary installation aid for holding a door in place relative to a door frame in a pre-hung door assembly, during transportation and installation of the door assembly in a building. The aid includes a wall having an inner surface and an outer surface, and a door clip extending from the wall inner surface. A jamb clip extends from the wall outer surface. The door clip is sized so as to fit over the door, and the jamb clip is sized so as to fit over the jamb. The door clip includes a pair of spaced apart arms extending from the wall inner surface. A finger extends from an end of at least one of the arms, and toward the opposite arm. The jamb clip includes a first leg extending from the wall outer surface, and a second leg extending upwardly from the first leg. The first leg has a length from the wall to the second leg which is slightly greater than the width of the door jamb.

Loop, U.S. Pat. No. 6,178,717 issued Jan. 30, 2001 discloses a door hanging system utilizing a series of metallic, elongated U-shaped clips which expand the area between the edge of the door opening and the door jamb. The metallic clips serve to as to support the weight of the door or door jamb during the adjustment phase of installation, and then properly anchor the same once orientation of the door has been achieved.

Gill, U.S. Pat. No. RE45,355 issued Feb. 3, 2015 discloses a door hanger utilizing a triangular shaped jamb mount with small jamb alignment and positioning tabs projecting perpendicular thereto. A wall mounting flange or tab projects laterally therefrom in the opposite direction from said jamb alignment and positioning tabs, and includes alignment notches to assist with alignment and positioning relative to a leveling plumb line placed on the mounting wall.

SUMMARY OF THE INVENTION

The present invention comprises a door hanger bracket, the combination of the door hanger bracket and a door jamb assembly, and the method of using the bracket to hang the door jamb assembly. The door hanger bracket comprises an elongated manually bendable body with a first wall mounting tab at one end, projecting laterally from said body. The elongated body extends from said first wall mounting tab for a distance approximately equal to the width of a door jamb, and sufficiently far beyond to provide for forming a second wall mounting tab. In a preferred embodiment of the invention, the body includes at least one bend line extending laterally with respect to the length of said body, whereby said body can be manually bent to form said second wall mounting tab.

In use, the bracket is secured to the back side of the door jamb, with said first wall mounting tab aligned with the first edge of the jamb so that it will engage the first side of said wall when the door assembly is placed. When the door assembly is placed in a wall opening, said first wall mounting tab is aligned and fastened to a first side of the wall. The elongated manually bendable body is then manually bent to engage the second surface of said wall, which is on the opposite side of said wall from said first side.

In the preferred embodiment with the "bend line," the above bending step is done at the bend line. The bend line facilitates the formation of a crisp right angel corner between said second wall engaging tab and the rest of said manually bendable body.

These and other objects, advantages and features of the invention will be appreciated by reference to the appended drawings and the Description of the Preferred Embodiments.

BRIEF DESCRIPTION OF THE DRAWINGS

The preferred embodiments of the invention will now be described with respect to the drawings, in which.

DESCRIPTION OF THE PREFERRED EMBODIMENTS

General Description

Figure 1:
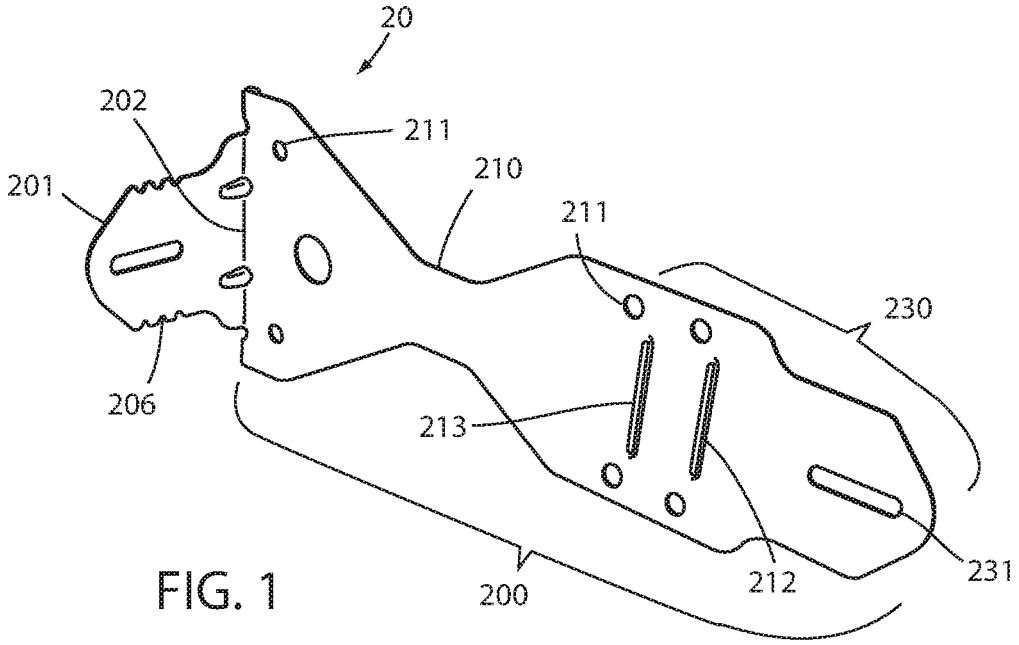
FIG. 1 is an inside perspective view of a preferred embodiment bracket.
Figure 2:
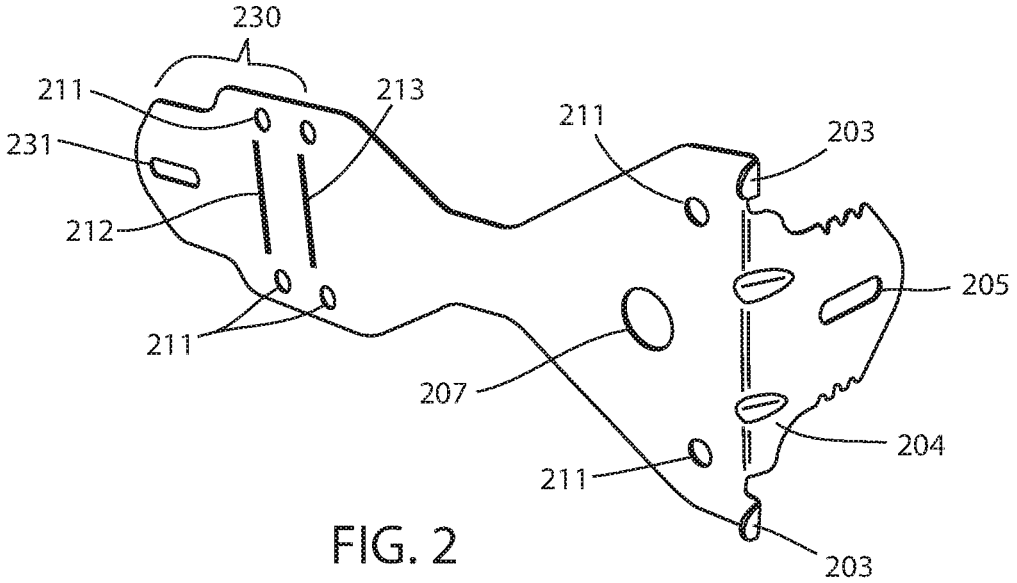
FIG. 2 is an outside perspective view of the preferred embodiment bracket.
Figure 8:
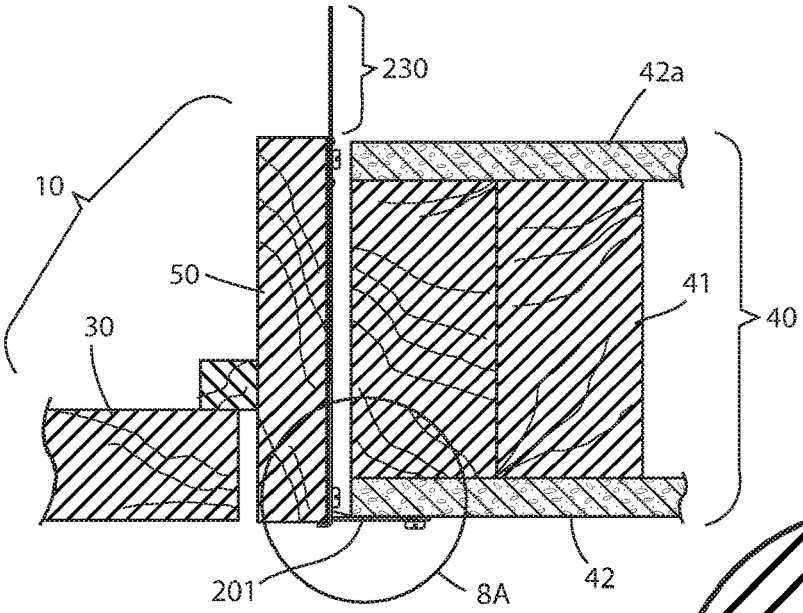
FIG. 8 is the cross section VIII-VIII of FIG. 6 showing the front side of the bracket attached to the wall, and the tail side of the bracket unbent.
Figure 9:
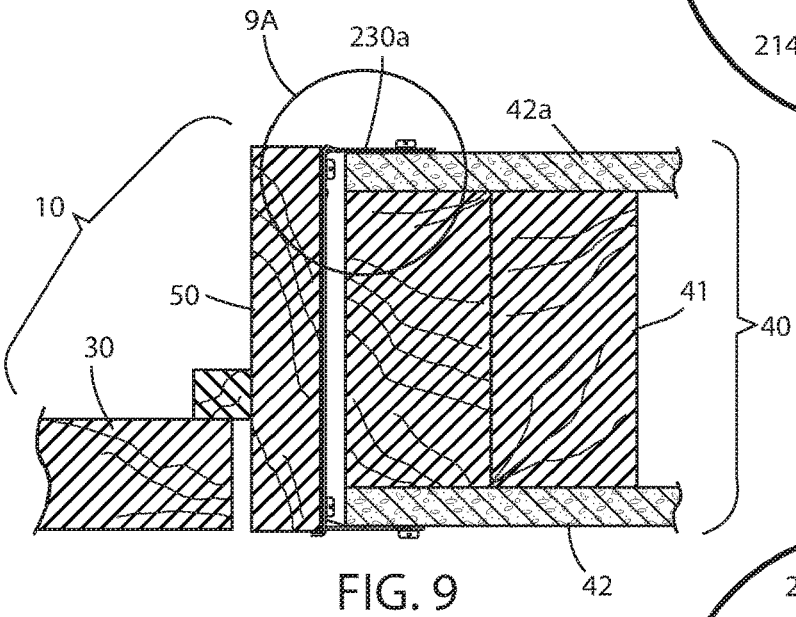
FIG. 9 is the cross section of FIG. 8 showing the front side of the bracket attached to the wall, and the tail side of the bracket bent and attached to the wall, with drywall on both sides.

In the preferred embodiments, the door hanger bracket 20 comprises an elongated manually bendable body 200 with a first wall mounting tab 201 at one end, projecting laterally from said body (FIGS. 1 and 2). Elongated body 200 extends from said first wall mounting tab 201 for a distance approximately equal to the width of a door jamb, and sufficiently far beyond to provide for forming a second wall mounting tab 230. Thus, elongated body 200 includes a jamb mounting portion 210 and a wall mounting tab portion 230. Body 200 includes at least one bend line 212 extending laterally with respect to the length of said body 200, whereby said body 200 can be manually bent to form said second wall mounting tab 230*a* (FIG. 3 and compare FIGS. 8 and 9).

Figure 10:
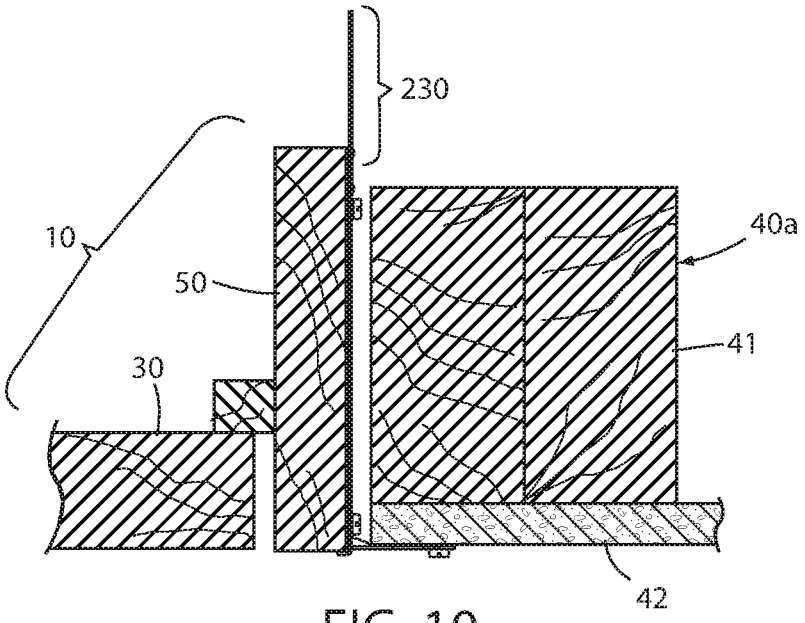
FIG. 10 is the cross section VII-VII of FIG. 6 showing the front side of the bracket attached to the wall, and the tail side of the bracket unbent, with an unfinished wall on the back side.
Figure 11:
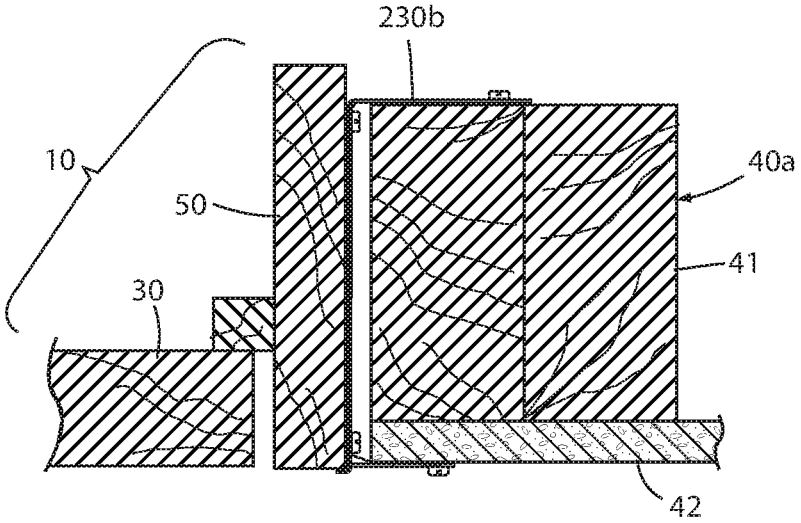
FIG. 11 is the cross section of FIG. 10 showing the front side of the bracket attached to the wall, and the tail side of the bracket bent and attached to the wall, with an unfinished wall on the back side.

Preferably, there are two said bend lines 212 and 213 spaced from one another along the length of said body 200. The first bend line 212 is located at a distance from said first wall mounting tab 201 which is approximately equal to the width of a finished wall 40 having dry wall 42 and 42*a* on both sides of said wall 40 (FIGS. 8 and 9). The second bend line 213 is located at a distance from said first wall mounting tab 201 which is approximately equal to the width of a wall 40*a* having dry wall 42 on only one side of said wall (FIG. 4 and compare FIGS. 10 and 11).

Figure 3:
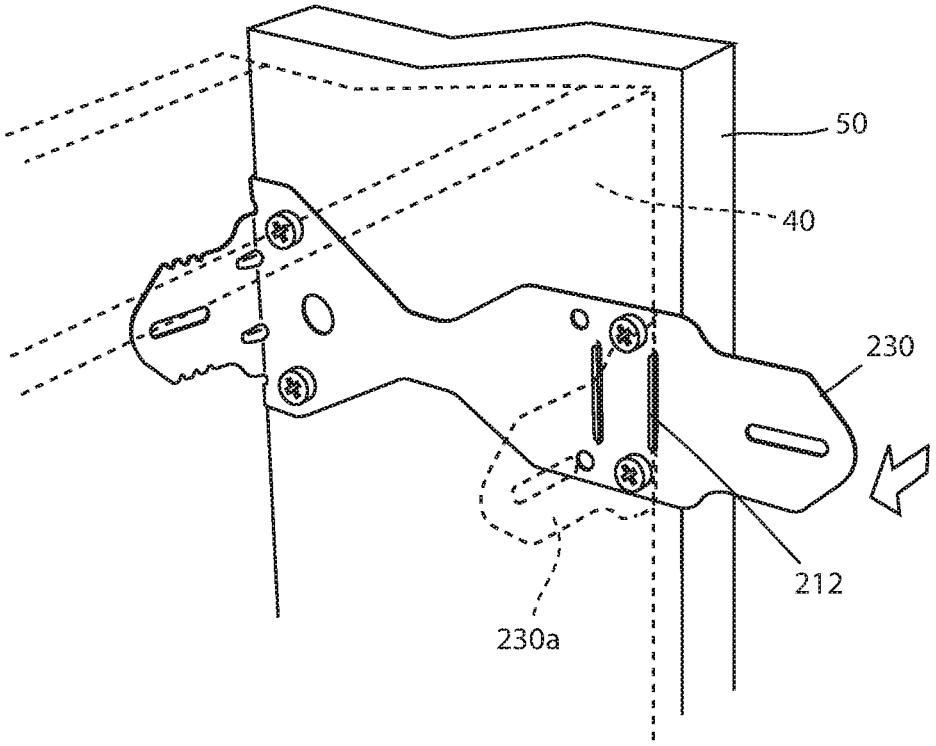
FIG. 3 is a fragmentary fragmentary perspective view of the door jamb with the bracket secured to the door jamb, where the door will be mounted to a wall having drywall mounted on both inside and outside wall surfaces.
Figure 4:
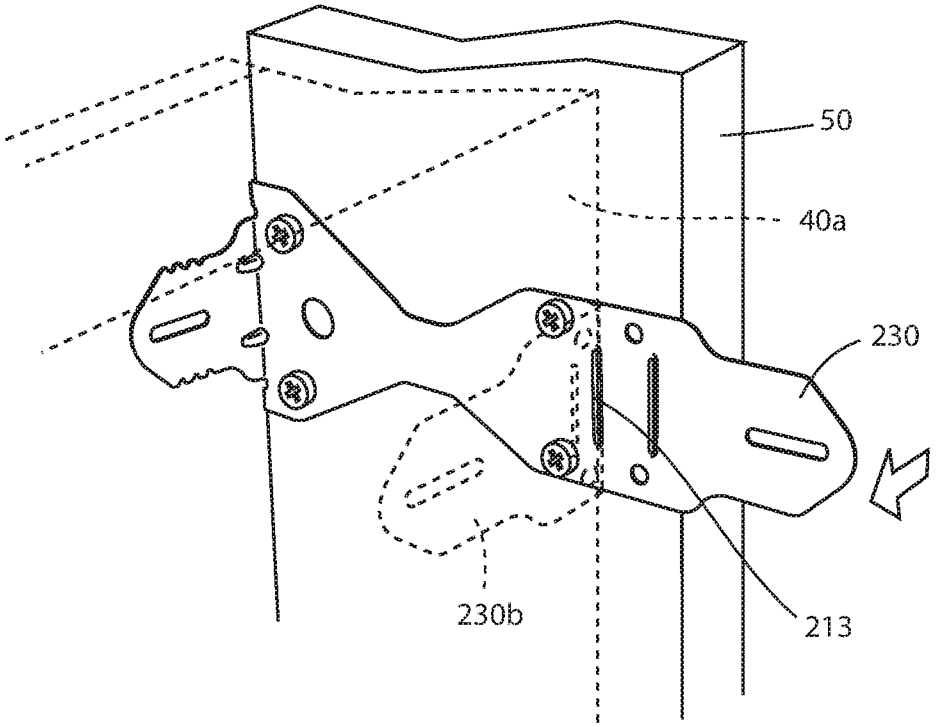
FIG. 4 is a fragmentary fragmentary perspective view of the door jamb with the bracket secured to the door jamb, where the door will be mounted to a wall having drywall mounted on only one of the wall surfaces.
Figure 5:
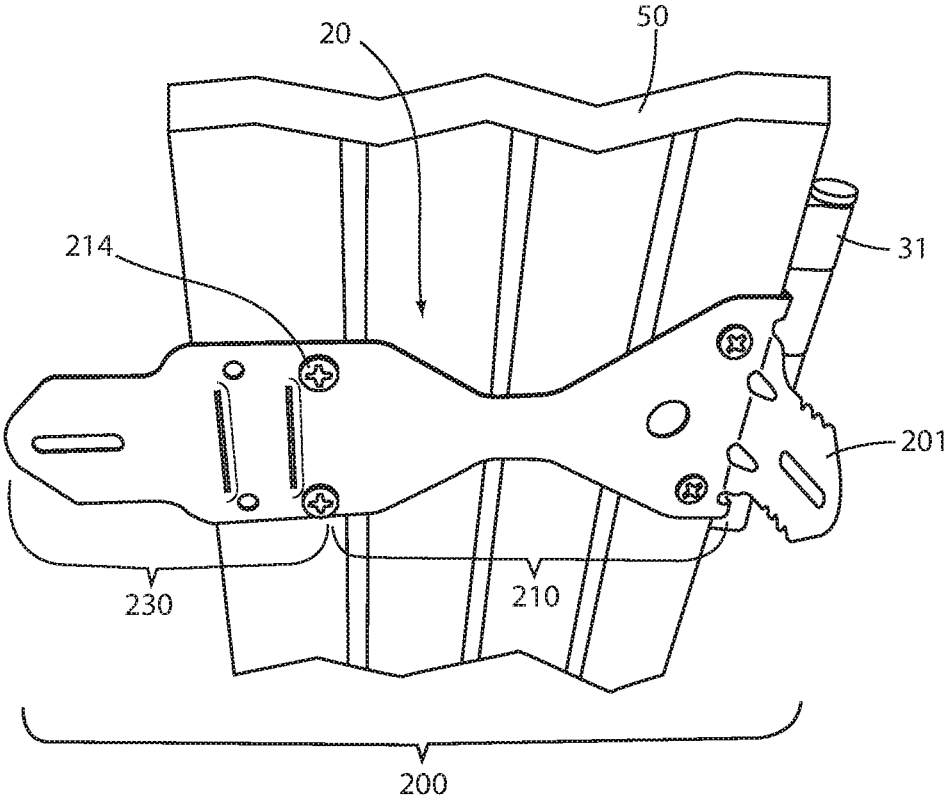
FIG. 5 is a perspective view of the bracket secured to the door jamb.
Figure 6:
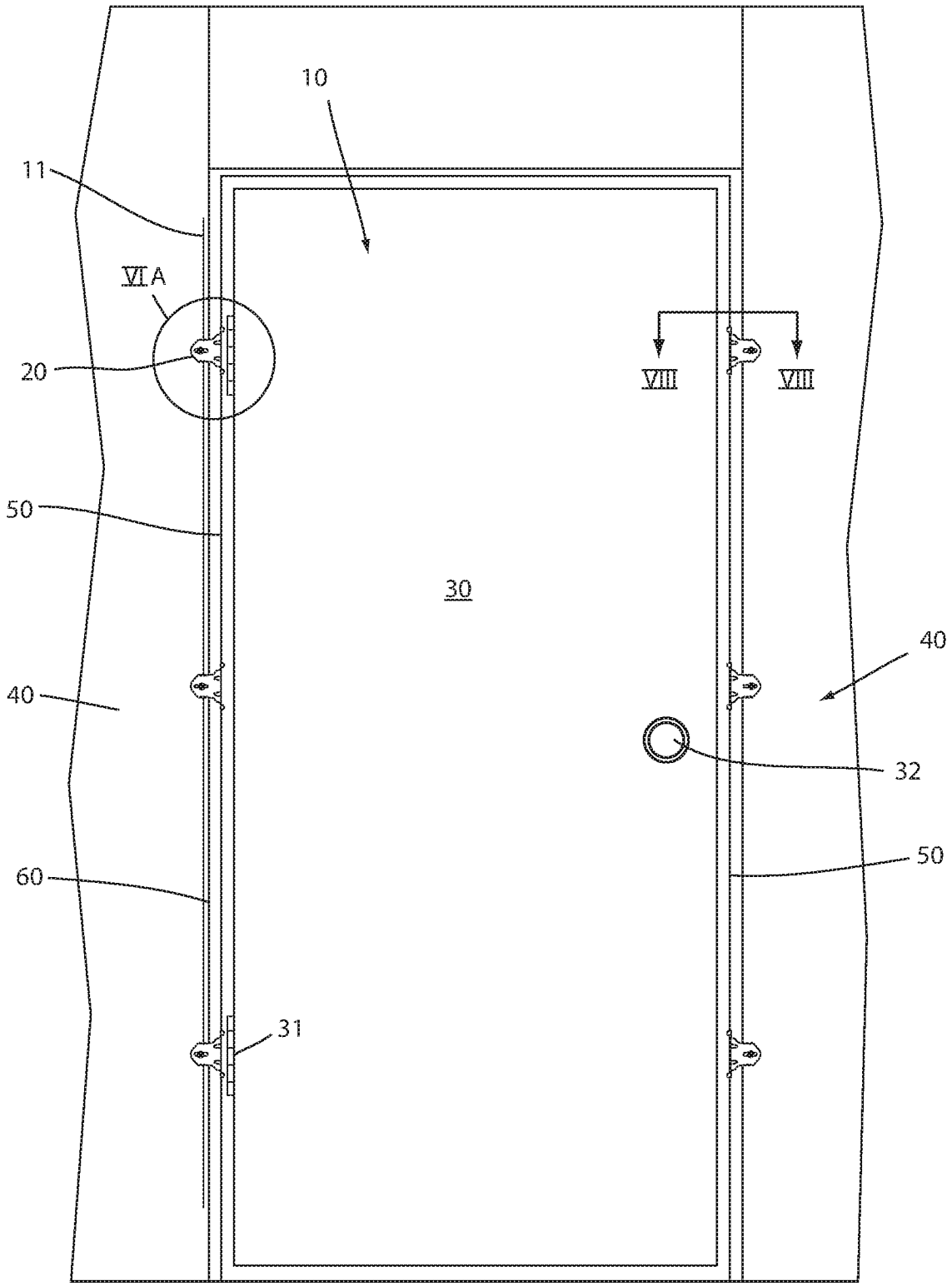
FIG. 6 is a front elevation of the door jamb positioned in the door opening, with three brackets on the hinge side and three brackets on the opening side, with all brackets attached to the wall.
Figure 6A:
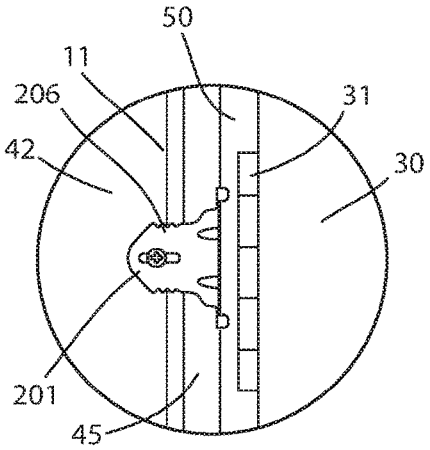
FIG. 6A shows the enlarged area VIA of FIG. 6.
Figure 7:
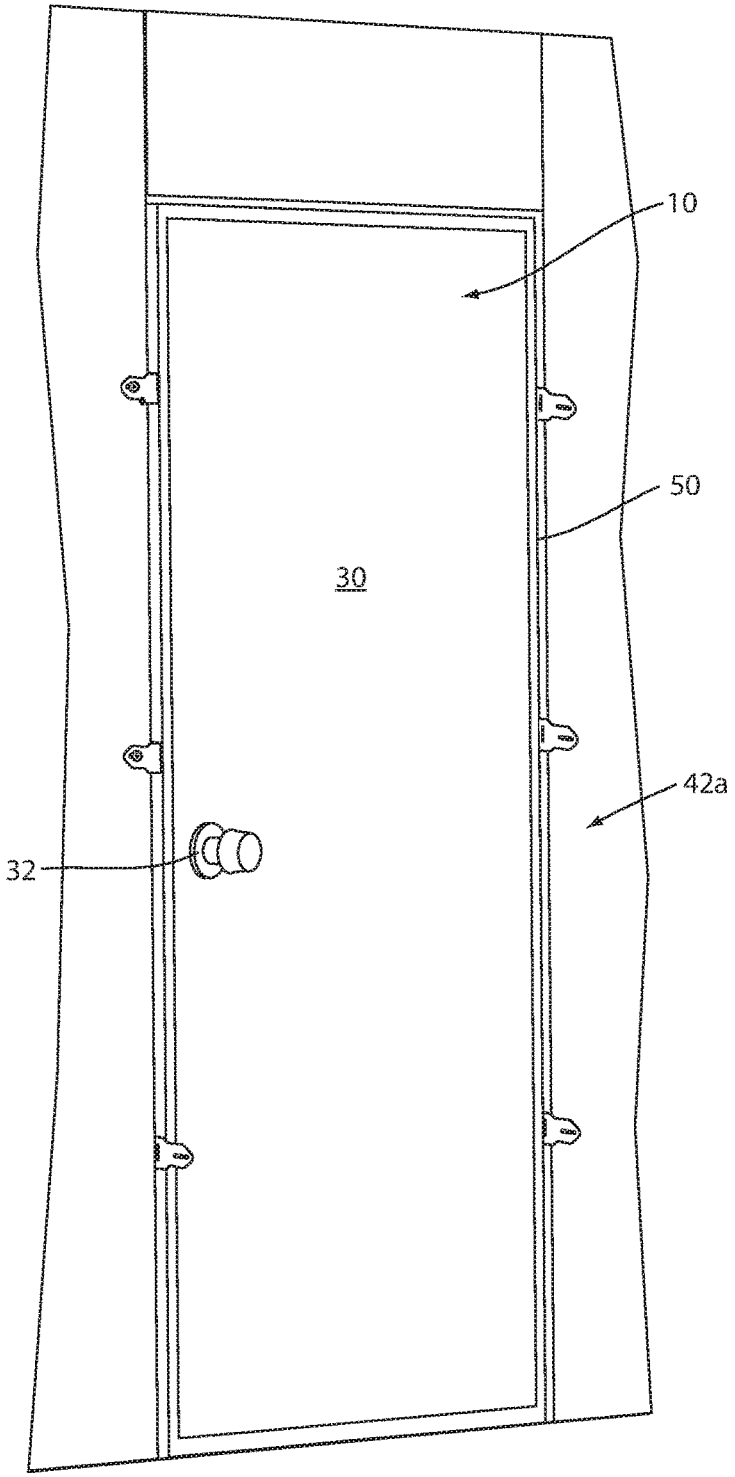
FIG. 7 is a rear elevation of the door jamb positioned in the door opening, with two of the brackets bent and secured to the wall, and the remaining four brackets yet to be bent.

In use with a door assembly 10 having a door jamb 50 and a hinged door 30, several brackets 20 are secured to jamb 50 with said first wall mounting tab 201 aligned with the edge of said jamb 50 with the help of positioning and alignment tabs 203, and with said manually formable elongated body 200 extending beyond the opposite edge of said jamb 50 (FIGS. 5, 3 and 4). The jamb and bracket assembly is then positioned in an opening in wall 40 (FIGS. 6 and 7). Wall 40 may be a finished wall as shown in phantom in FIG. 3, having dry wall 42 and 42*a* on both sides (FIGS. 8 and 9). Alternatively, it may be a narrower wall 40*a* as shown in phantom in FIG. 4, having drywall on only one side, and perhaps nothing or only a thin covering on the other side (FIGS. 10 and 11). If it is a wall 40 having dry wall on both sides, the extending portion 230 of elongated body 200 is manually bent at first bend line 212, to form a second wall mounting tab 230*a*. Tab 230*a* is then secured to wall 40 through the drywall 42*a* (FIGS. 8 and 9). If it is a wall 40*a* having drywall on only one side, the extending portion 230*a* is bent at second bend line 213, to form a longer second wall mounting tab 230*b*. Tab 230*b* is then secured to the wall stud 41 (FIGS. 10 and 11).

Preferably, brackets 20 are made of a bendable metal such as steel, galvanized steel, aluminum or other reasonable materials. The thickness of the bracket material depends on the strength of the material selected, and the amount of security required for the finished door assembly installation. A range of thickness from 0.020-0.125 inches can be used for most bendable materials. A preferred metal is a galvanized and heat treated steel, commonly known as Galvaneal, with a thickness of about 0.030 inches. Preferably, the metal is formed into manually formable bracket 20 by stamping.

Terminology and Parts

The terms "lateral" as used herein means "generally perpendicular to." Similarly the term "perpendicular" as used herein means "generally perpendicular," or "essentially perpendicular." The term "approximately equal" is used to allow for limited variation from precise equality which is not sufficient to interfered with the intended functionality of the "approximately equal" components or features of door hanger bracket 20. The components discussed herein are numbered as shown below:

10—Door Assembly
11—Plumb Line
20—Door Hanger Bracket
30—Door
31—Door Hinge
32—Door Latch
40—Wall—standard thickness
40*a*—Wall—narrower thickness
41—Wall Stud
42—First side Wall Surfacing Material (drywall)
42*a*—second side Wall Surfacing Material (drywall)
44—Wall mounting screw
50—Door Jamb
60—Rough Wall Opening
20—Door Hanger Bracket
200—Manually bendable elongated body, sometimes referred to herein as main body 200
201—Preformed first wall mounting Tab
202—Preformed corner
203—Preformed bracket positioning tab(s)
204—Preformed gussets
205—First wall mounting slot
206—wall alignment marks
207—Hinge Screw Compensation Hole
210—jamb mounting portion of elongated body 200
211—Doorjamb mounting holes
212—Preformed bend line/notch(s)
213—Second preformed bend line/notch
214—Jamb mounting screw
230—Second wall mounting tab forming portion of elongated body 200
230*a*—manually bent second wall mounting tab for a full width wall
230*b*—manually bent second wall mounting tab for narrow wall
231—second wall mounting slot
234—in-situ gusset
25—Single wall door hanger bracket
210*a*—triangular jamb mounting body Bend Lines The bend line features 212 and 213 can be formed as narrow slots, grooves, or a series of drilled holes though it is most preferable to stamp the bend lines into metal main body 200 to form elongated narrow notches, which might also be described as grooves (FIGS. 1 and 2). The elongated narrow notch partially penetrates the surface of the metal on the jamb wall facing surface of said main body, and the metal to either side of the penetrating portion of the notch slopes downwardly slightly to the penetrating portion. Preferably, the notches 212/213 are stamped into the jamb mounting side of main body 200, to project slightly from the surface of the wall facing side of main body 200. Accordingly, one is bending main body 200 in the same direction which the notch 212 or 213 projects. One would think that the notches 212 and 213 should be made in the wall facing side of main body 200, to provide bend relief on the inside corner of the manual bend which forms said second wall mounting tab 230. We have found surprisingly, that by forming bend lines 212 and 213 to project into the inside corner to be formed, the bending of main body 200 is easier and forms a sharper, tighter radius bend at the corner of formed tab 230 and main body 200.

Figure 9A:
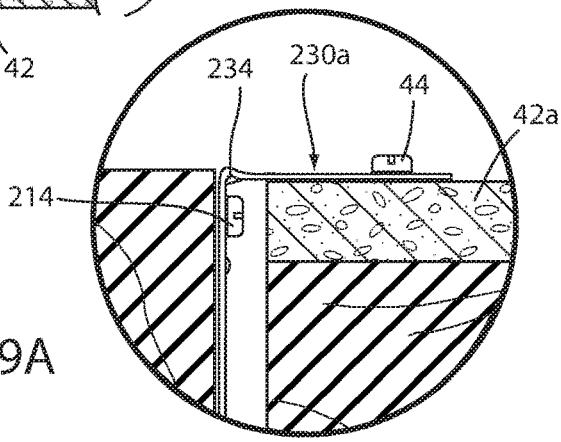
FIG. 9A is the enlarged area of FIG. 9.

Also, preferably, bend lines 212 and 213 extend only partially across the lateral width of main body 200, stopping short of the side edges of main body 200. Further, it has been discovered by locating the door jamb mounting holes 211 and the heads of the jamb mounting screws 214 near the bend line notch 212/213 provides a stress relief pattern extending from each end of the bend line, which upon manual bending forms an in-situ gusset 234 above and below the bend line (FIG. 9A). This improves the stability of the second wall mounting tab 230 when bent and attached to the wall.

Typically, on a bracket with a width of 1.5-2.0 inches the optimum bend line notch has a length of ½ to ⅞ inches, with length of ¾ inch most preferred. In accordance with this notch size, the jamb mounting holes 211, which are typically 1/16 to ¼ inch in diameter with 3/16" diameter preferred, would be set inward (towards the first wall mount tab 201) from the bend lines 212 and 213 notch placement about 1/16 to ⅛ inch, and approximately ⅛-¼ inch outside of the ends of the bend line notches 212 and 213 (See FIGS. 1 and 2.)

Pre-formed Wall Mounting Tab

At least one smaller bracket positioning tab(s) 203 is formed at the first wall mounting tab 201 end of main body 200 essentially parallel to and projecting in the opposite direction from said first wall mounting tab to enhance the alignment and positioning of said bracket to said door jamb (FIG. 2). Preferably, one of said tabs 203 is located above and one below said first wall mounting tab 201.

Figure 8A:
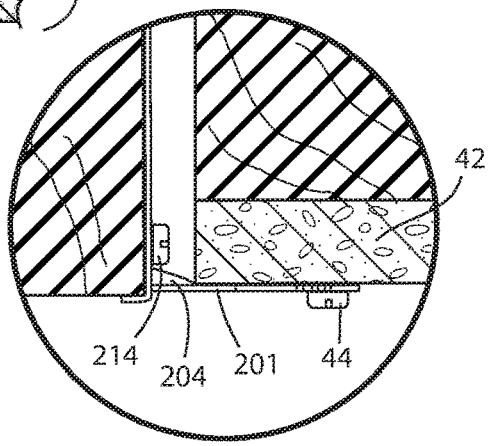
FIG. 8A is the enlarged area of FIG. 8.

Preferably at least one, preferably two preformed gussets 204 are impressed into said first wall mounting tab 201 to project into the inside corner of the junction between first wall mounting tab 201 and main body 200. Said gussets 204 extend from said inside corner into said wall mounting tab 201 to a distance which is just sufficient to leave a space 45 between the end of the wall 40 and face of jamb 50, which will accommodate the heads of the jamb mounting screws 214 (FIG. 8A). Typically, this distance is ⅛ to ⅜ of an inch, and preferably ¼ of an inch. The gussets are impressed inwardly into said tab 201 to a depth of 1/16-¼ of an inch, with a depth of approximately ⅛$^{th}$ inch most preferred. The width of the gusset 204 is typically ⅛ to ¼ of an inch at their widest point, depending on the thickness of the metal used and the spacing of the gussets. It is understood that the number, size, and specific location of the pre-formed gusset design can be reasonably altered to accommodate specialized bracket designs depending on the strength and thickness of the bracket material being used, as well as accommodations required for unique door assembly requirements.

In addition to improving the strength and quality of the finished door assembly, said gussets also make the packaged brackets stronger and more durable during normal shipping and handling associated with transportation and construction site applications which tend to bend or straighten many preformed features.

Jamb Mounting Body Design

The thickness and width of the door hanger bracket 20 can be adjusted in a variety of manners to adjust for the specific door assembly to be installed. The dimensions provided above typical for those used with a standard interior door assembly installation. It has been determined for this standard inside door application that several irregular shape profiles can be used on the jamb mounting portion of the bracket to optimize manufacturing efficiencies without compromising the strength and integrity of bracket 20. In the preferred embodiment, jamb mounting portion 210 of main body 200 is shaped in a bow tie fashion to provide sufficient strength at both the first wall tab 201 and the manually formed second wall tab 230, while tapering down in the middle portion of main body to minimize material utilization. The bow tie shape also facilitates stamping multiple brackets out of a sheet of metal in "nesting fashion" optimizing material utilization.

Door Assembly Installation Process

Turning to the drawings, a standard indoor door assembly 10 (shown in FIG. 6) is installed in a rough door opening 60 of the wall 40. A plumb line 11 is scribed on the hinge side 42 of first wall side 40 adjacent to the intended hinge 31 side of the door jamb 50. Plumb line 11 extends from above the desired location of the top bracket 20 and continuing to below the desired location of the bottom door mounting bracket 20. The plumb line 11 is typically located on wall 40 approximately ¼-1 inch away from the edge of the rough door opening 60 such that the preformed wall mounting tab 201 will cover a portion of the plumb line 11 during the installation of the door assembly. The proximity of the plumb line 11 to the preformed wall mounting tab 201 is then such that at least one of the wall alignment marks 206 overlays the plumb line and provides the means for the installer to have a ready reference for properly leveling the door assembly during installation.

Upon locating the hinge side of door assembly, the installer can locate the bracket 20 on the hinge 31 side of the door jamb 50 with the first wall tab 201 located on the first wall 40 side of the opening with said tab extending away from the door jamb. Using the preformed bracket positioning tabs 203 the bracket location can be easily set such that the bracket is quickly located in close proximity to the door hinge 31 and essentially perpendicular with the hinge side door jamb which provides for minimal tab protrusion challenges during final trim assembly. If additional security is desired for the finished door assembly, the bracket 20 can be aligned with the hinge 31 such that one of the hinge screws aligns with the hinge screw compensation hole 207 on the bracket. This allows for the subsequent installation of an extra-long screw to be driven thru the jamb 40 and bracket 20 into the stud wall 41.

At this point the installer can drive in 2 or more, and preferably 4 jamb mounting screws 214 thru the jamb mounting holes 211 in the bracket and into the door jamb 50. The same process is completed for a second bracket 20 in close proximity to the remaining hinge 31 of the door assembly. If added security or strength is needed additional brackets may be added to the door flange at this time, with spacing of additional brackets determined to provide the best stress distribution possible.

Alternative Gusseted Embodiment

Figure 12:
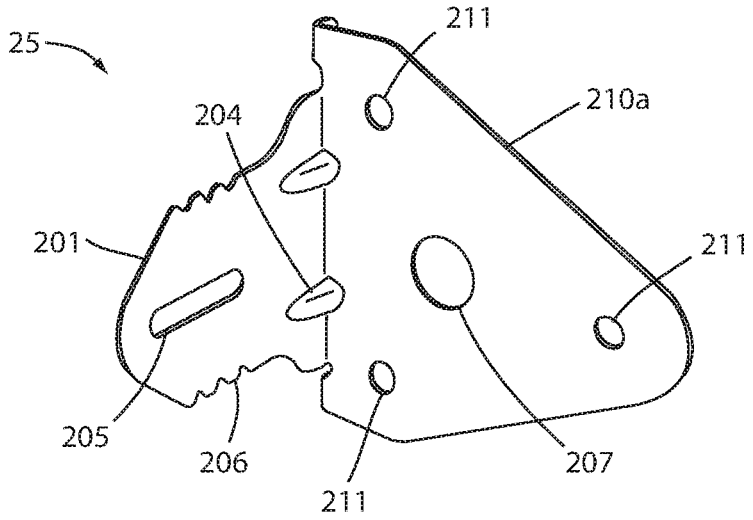
FIG. 12 shows an inside perspective view of an alternative one side mount bracket.
Figure 13:
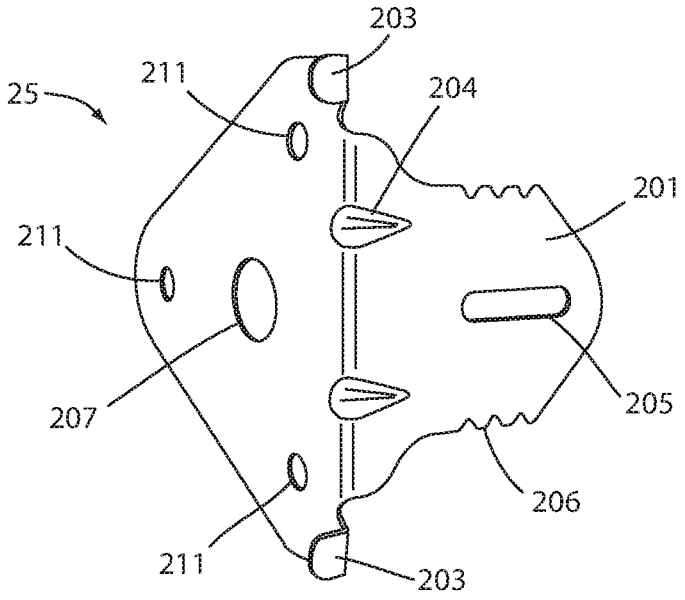
FIG. 13 shows the outside perspective view of the alternative bracket of FIG. 12.

FIGS. 12 and 13 disclose an alternative embodiment door hanger bracket 25 having a main body which comprises only a triangular shaped jamb mounting portion 210*a* and a laterally projecting gusseted wall mounting tab 201 as described above. Jam mounting main body 210*a* includes jamb mounting holes 211 and a hinge screw compensation hole 207. It also includes positioning and alignment tabs 203 projecting laterally from the same edge as wall mounting tab 201 projects, but in the opposite direction and on either side thereof as described above.

Wall mounting tab 201 includes two gussets 204 as described above alignment notches 206 and wall mounting slot 205 as described above. This embodiment does not include a manually formable second wall mounting tab.

CONCLUSION

It is understood that several bracket widths and material variations can be selected depending upon the door assembly requirements involved. These may require adjustments to the dimensional layout provided above, and the basis of this example is provided for a preferred bracket design for a standard interior door installation with standard material sizes involved.

It is further understood that the number and spacing of the bend lines may vary for custom or non-standard door assembly designs and the specific example provided should not be considered limiting to this invention. For example, it may be desirable to have 3 or 4 bend lines established for customized door assemblies used in specialized clean room operations where standard ½-inch drywall is not commonly used and specialized fiberglass or plastic wall coverings, and other various combinations can create a wider variety of finished wall thickness requirements which would benefit from adding additional bend line features.

Of course, it is understood that this is a preferred embodiment, and that various changes and alterations can be made without departing from the spirit and scope of the invention as set forth in the appended claims.

The invention claimed is:

1. A door hanger bracket comprising: a flat elongated bendable body having an irregular shape; a pre-formed first wall mounting tab projecting laterally from a first end of said elongated manually bendable body: said elongated manually bendable body extending from said first wall mounting tab for a distance approximately equal to the width of a doorjamb, and sufficiently far beyond to provide for forming a second wall mounting tab; said elongated manually bendable body including at least one bend line extending laterally with respect to the length of said elongated manually bendable body, whereby after said elongated manually bendable body has been passed through the space between a doorjamb and a wall opening, said elongated manually bendable body can be manually bent at said at least one bend line to form said second wall mounting tab projecting laterally from said elongated manually bendable body at said at least one bend line.

2. The door hanger bracket of claim 1 in which said at least one bend line comprises first and second bend lines spaced from one another along the length of said elongated manually bendable body; said first bend line being located at a distance from said first wall mounting tab which is approximately equal to the width of a finished wall having dry wall on both sides of said wall; said second bend line being located at a distance from said first wall mounting tab which is approximately equal to the width of a wall having dry wall on only one side of said wall, whereby said second wall mounting tab can be formed by bending said elongated manually bendable body at either said first bend line or said second bend line.

3. The door hanger bracket of claim 2 in which each said first and second bend lines comprise an elongated narrow notch in said elongated manually bendable body.

4. The door hanger bracket of claim 3 in which said elongated manually bendable body has a lateral width with side edges circumscribing said lateral width; each said elongated narrow notch extending only partially across said lateral width of said elongated manually bendable body, stopping short of said side edges of said elongated manually bendable body.

5. The door hanger bracket of claim 4 in which each said elongated narrow notch partially penetrates the surface of said elongated manually bendable body.

6. The door hanger bracket of claim 5 in which said elongated manually bendable body having a jamb facing surface which will face a door jamb when said bracket is secured to said door jamb, and a wall facing surface which will face the wall when an assembled door hanger bracket and said door jamb are positioned in a wall opening; said elongated narrow notch penetrating said jamb facing surface of said elongated manually bendable body.

7. The door hanger bracket of claim 6 in which said elongated manually bendable body is formed of a manually bendable metal; each said at least one bend line being stamped into said jamb facing surface of said elongated manually bendable body to form each said elongated narrow notch; each said elongated narrow notch projecting slightly from said wall facing surface of said elongated manually bendable body, whereby when one is bending said elongated manually bendable body to form said second wall mounting tab, one is bending in the same direction into which said elongated narrow notch projects.

8. The door hanger bracket of claim 7 in which door jamb mounting holes are positioned offset from but near the ends of each said bend line, whereby upon manual bending said elongated manually bendable body at either of said bend lines, in-situ gussets are formed above and below said elongated narrow notch.

9. The door hanger bracket of claim 2 in which at least one bracket positioning tab is formed at said first end of said elongated manually bendable body, essentially parallel to and projecting in the opposite direction from said first wall mounting tab to enhance the alignment and positioning of said bracket on said door jamb.

10. The door hanger bracket of claim 2 in which said door hanger bracket is made of manually bendable metal, and at least one preformed gusset is impressed into said first wall mounting tab so as to project into the inside corner of the junction between first wall mounting tab and elongated manually bendable body; said gusset extending from said inside corner into said wall mounting tab to a distance which is just sufficient to serve as a spacer between said elongated bendable body and the end of the wall to which said wall mounting tab is secured, thereby leaving leave a space so as to accommodate the heads of screws used to mount said bracket on a jamb.

11. The door hanger bracket of claim 10 in which said gusset extends from said inside corner a distance of from ⅛ to ⅜ of an inch; said gusset extend inwardly into said tab to a depth of from 1/16 to ¼ of an inch.

12. The door hanger bracket of claim 11 in which there are two said gussets in said first wall mounting tab.

13. The door hanger bracket of claim 1 in which said elongated manually bendable body is formed of a manually bendable metal; said elongated manually bendable body having a jamb facing surface which will face a door jamb when said bracket is secured to a said door jamb, and a wall facing surface which will face the wall when an assembled door hanger bracket and said door jamb are positioned in a wall opening;

each said bend line being stamped into said jamb facing surface of elongated manually bendable body to form said elongated narrow notch; each said elongated narrow notch projecting slightly from said wall facing surface of said elongated manually bendable body, whereby when one is bending said elongated manually bendable body to form said second wall mounting tab, one is bending in the same direction into which said elongated narrow notch projects.

14. The combination of a plurality of door hanger brackets attached to a pre-hung door assembly comprising a jamb, a door, and hinges joining said door to said jamb; each of said door hanger brackets being the bracket of claim 1.

15. The combination of claim 14 in which each of said door hanger brackets is the bracket of claim 2.

16. The combination of claim 14 in which each of said door hanger brackets is the bracket of claim 13.

17. The door hanger bracket of claim 4 with said elongated manually bendable body having a jamb facing surface which will face a door jamb when said bracket is secured to a door jamb, and a wall facing surface which will face the wall when an assembled door hanger bracket and jamb are positioned in a wall opening; said elongated narrow notch penetrating the surface of said jamb facing surface of said elongated manually bendable body.

18. The door hanger bracket of claim 17 in which said bracket is formed of a manually bendable metal; each said bend line being stamped into said jamb facing surface of elongated manually bendable body to form said elongated narrow notch; said elongated narrow notch projecting slightly from said wall facing side of elongated body, whereby when one is bending elongated body to form said second wall mounting tab, one is bending in the same direction into which said notch projects.

19. A method for securing a pre-hung door having a door, a jamb having first and second spaced sides and a top cross piece, and hinges securing said door to said first side of said jamb, said method comprising:

securing a plurality of door hanger brackets to said hinged first side jamb of said pre-hung door assembly;

each said door hanger bracket comprising: a flat elongated manually bendable body having an irregular shape; a first wall mounting tab projecting laterally from a first end of said elongated manually bendable body; said elongated manually bendable body extending from said first wall mounting tab for a distance approximately equal to the width of a door jamb, and sufficiently far beyond to provide for forming a second wall mounting tab; said elongated manually bendable body including at least one bend line extending laterally with respect to the length of said elongated manually bendable body, whereby said elongated manually bendable body can be manually bent at said bend line to form said second wall mounting tab projecting laterally from said elongated manually bendable body at said bend line;

said step of securing a plurality of door hanger brackets to said hinged first side jamb of said pre-hung door assembly comprising aligning said preformed wall mounting tab with said front edge of said hinged first side iamb and securing said elongated body to said wall opening facing side of said first side jamb;

positioning said pre-hung door assembly with said secured hanger brackets in a door opening of a wall having first and second sides, with said first wall mounting tabs adjacent said first wall side, and thereby passing said, elongated bendable body through the space between said door iamb and said wall opening;

securing said first wall mounting tabs of said brackets to their adjacent first wall side;

bending said elongated manually bendable body of each said bracket at said bend line to form said second wall mounting tabs adjacent said second wall side;

securing said second wall mounting tabs to said second wall side.

20. The method of claim 19 which includes using wall mounting brackets in which said at least one bend line comprises first and second bend lines spaced from one another along the length of said elongated manually bendable body; said first bend line being located at a distance from said first wall mounting tab which is approximately equal to the width of a finished wall having dry wall on both sides of said wall; said second bend line being located at a distance from said first wall mounting tab which is approximately equal to the width of a wall having dry wall on only one side of said wall; said step of bending including bending said elongated body at either said first or said second bend line, depending on the thickness of said wall.

21. The method of claim 20 in which said brackets used are formed of a manually bendable metal;

said elongated manually bendable body having a jamb facing surface which will face a door jamb when said bracket is secured to a said door jamb, and a wall facing surface which will face the wall when an assembled door hanger bracket and said door jamb are positioned in a wall opening; each said bend line being stamped into said jamb facing surface of elongated manually bendable body to form said elongated narrow notch; each said elongated narrow notch projecting slightly from said wall facing surface of said elongated manually bendable body, whereby when one is bending said elongated manually bendable body to form said second wall mounting tab, one is bending in the same direction into which said elongated narrow notch projects.

* * * * *